United States Patent [19]

Beebe

[11] Patent Number: 4,712,925

[45] Date of Patent: Dec. 15, 1987

[54] PENDULUM TYPE DECORATIVE AND TIME INDICATING DEVICE

[76] Inventor: William B. Beebe, 2832 Main St., Bethlehem, Pa. 18017

[21] Appl. No.: 7,725

[22] Filed: Jan. 27, 1987

[51] Int. Cl.[4] ..... G04B 17/02

[52] U.S. Cl. ..... 368/179; 368/223; 368/229; 368/165; 368/134

[58] Field of Search ..... 368/179, 165, 134, 223, 368/225, 228, 229, 76

[56] References Cited

FOREIGN PATENT DOCUMENTS 161682 10/1982 Japan ..... 368/229

*Primary Examiner*—Bernard Roskoski

*Attorney, Agent, or Firm*—Charles A. Wilkinson

[57] ABSTRACT

A clock is provided with at least partially upwardly disposed time indicia and a pendulum is arranged to oscillate above the correct indicia to indicate current time. The clock may take any one of a number of embodiments, the common factor being the oscillation of a pendulum above or adjacent to the current time, which may be mounted upon various clock faces, endless strips, rotating rings, and other arrangements over which a pendulum is arranged to oscillate to at least partially indicate the correct time. Auxiliary means such as lights or the like may be used to aid in the indication of the correct time.

18 Claims, 9 Drawing Figures

PENDULUM TYPE DECORATIVE AND TIME INDICATING DEVICE

CROSS REFERENCE TO RELATED APPLICATIONS

This application is one of four related applications concurrently filed by the present inventor, the related applications being for a Magnetically Controlled Arrhythmic Pendulum Device, a Pendulum Indicator Horological Device, and a Decorative Horological Device, the latter application being a design application.

BACKGROUND OF THE INVENTION

1. Field of the Invention

This invention is generally directed to pendulum type devices and is more particularly directed to pendulum type horological devices and more particularly still to a horological device wherein a pendulum is used to indicate the time or to partially indicate the time.

2. Description of the Prior Art

It is well known that the oscillations of the so-called gravity pendulum, as opposed to a torsion pendulum, has a period dependent upon the length (l) of the suspension of the pendulum bob and the acceleration of a freely falling body (g) due to gravity in accordance with the well known equation:

$$T = 2\pi\sqrt{\frac{l}{g}}$$

Since acceleration in a gravity field is the same for all objects, disregarding air resistance and the like, all pendulums having the same suspension length will swing with the same harmonic motion along a vertically oriented curved path, i.e. with the same simple periodic motion, and, if started together with small amplitude, single pendulums of different masses will swing in synchronism. It was Huggins who in the seventeenth century first adapted the pendulum to regulate a mechanism for keeping time and thereby originated the first accurate clock mechanism. The use of a pendulum, therefore, as a time keeping device is of fairly ancient vintage. One well known example is the use of a pendulum in a grandfather's clock. In the grandfather's clock the pendulum is used not only to regulate the clock mechanism, but is also used as a decorative feature, the regular movement of which is interesting to the observer. With the arrival of modern technology the pendulum has no longer been as useful as a time keeping mechanism. However, its popularity as a decorative feature has continued and dummy pendulums having no time regulating or horological function have continued to be used in clocks. In such clocks the pendulum merely mimics the normal utilitarian function of a pendulum while providing an eye attracting movement as a decorative feature of the horological device. Exemplary disclosures of such devices may be found in the following U.S. patents.

U.S. Pat. No. 2,722,097 issued Nov. 1, 1955 to J. Lefrand discloses a conical pendulum alternating current clock wherein the pendulum motion both drives and regulates the clock mechanism. In the Lefrand device the clock is controlled by the frequency of a pendulum formed of electrically conductive material and caused to swing in a conical path by means of a rotating or oscillating electric field, as in an induction motor.

U.S. Pat. No. 2,995,005 issued Aug. 8, 1961 to R. L. Boyles describes a swinging pendulum clock, "the pendulum motion of which is utilized for other than timekeeping purposes and does not control the operation of the clock mechanism."

U.S. Pat. No. 3,762,154 issued Oct. 2, 1973 to C. Petrides is directed to a simulated pendulum clock wherein the "pendulum is functionally separated from a timekeeping movement for driving the hands of the clock."

U.S. Pat. No. 3,762,155 issued Oct. 2, 1973 to C. B. Marble is also directed to a pendulum clock wherein the pendulum is functionally separated from the timekeeping movement which drives the hands of the clock. The '155 patent is particularly directed to a pendulum arm with an upper pendulum drive arm having a permanent magnet positioned adjacent to an electromagnetic movement for driving the pendulum and a lower pendulum arm removably connected to the upper pendulum arm.

U.S. Pat. No. 3,903,684 issued Sept. 9, 1975 to A. Wilson discloses a pendulum type time or interval keeper in which the swing of a pendulum per se indicates elapsed periods of time. The pendulum includes a magnetic means which interacts with a second magnetic means mounted on the base in a keeper. The magnetic means is not used for adding energization to the swings of the pendulum or determining the position to which the pendulum swings, but serves instead to operate the keeper at the conclusion of movement.

U.S. Pat. No. 3,924,401 issued Dec. 9, 1975 to E. Heim discloses the provision of a dummy torsion pendulum (as opposed to an oscillating pendulum) under a clock mechanism.

U.S. Pat. No. 4,121,416 issued Oct. 24, 1978 to C. Niemczyk discloses a dummy oscillating pendulum periodically energized by solenoid coil means energized momentarily during the pendulum oscillations by contact switch means.

U.S. Pat. No. 4,203,282 issued May 20, 1980 to B. Radzun is broadly similar to the dummy torsion arrangement shown in U.S. Pat. No. 3,924,401 to Heim described above.

U.S. Pat. No. 4,468,132 issued Aug. 28, 1984 to N. Nakamura discloses a swinging body clock in which oscillation of the body of the clock as well as an attached pendulum is effected by magnetic means hidden within or behind the clock case.

While the above described devices have provided a varied repertory of clock type devices in which a pendulum is used other than as a time regulating means, but is used instead as an attention attracting or decorative device, none makes use of the pendulum as a time indicating device as contrasted with a time regulating or time measuring device.

It is an object of the invention, therefore, to provide a unique and attractive timekeeping device utilizing a pendulum.

It is a further object of this invention to provide a timekeeping device wherein a pendulum functions as a time indicator means.

It is another object of this invention to provide a timekeeping device which is driven either electrically or mechanically and incorporates a pendulum as at least part of the time indicating means.

It is a still further object of this invention to provide a timekeeping or horological device in which a pendulum serves as a novel and attractive time indicating means.

Other objects and features of the device will be evident from the following description and illustrations of the invention.

SUMMARY OF THE INVENTION

The instant invention accomplishes the above objects by providing a timekeeping device having a pendulum bob adapted to swing freely from a fixed point above the timekeeping device in an oscillatory fashion. A clock mechanism for driving the time keeping means is provided. Magnetic means mounted to the side of the time keeping means is provided to attract the swinging pendulum, adding energy to such pendulum and possibly momentarily holding it over or adjacent to a time indicating position of the time keeping means and then allowing it to continue its free swing or oscillating motion. The magnetic means is adapted to be energized intermittently through a timing mechanism. The time keeping means may be either of the analog type such as a clock face or the like or of the digital type where discontinuous times are indicated and the pendulum may be the principal or only time indicating means or may serve as one of several or as an auxiliary time indicating device.

DESCRIPTION OF THE PREFERRED EMBODIMENTS

Pendulum type clocks have been popular pieces of furniture in homes, offices and places of business for many years. The so-called grandfather's clock is an outstanding example of this type of clock. However, in these previous pendulum clocks the function of the pendulum, as an integral time regulating portion of the clock mechanism, has been to regulate the advancement of the hour, minute and second hands by virtue of the regular back and forth swinging, or oscillating, motion of the pendulum. More recently with the popular use of electric energy to drive clock mechanisms, the pendulum, no longer needed to regulate the advancement of the clock mechanism, has been added to simulate a pendulum clock and produce an attractive ornamental piece. The time keeping function of the clock is provided by an electric or spring loaded motor that drives the clock mechanism and also provides the drive for the pendulum. In contrast, in the present invention a pendulum is used not merely as an ornamental device, but is also used at least partially as a time indicating device or one of the time indicating devices or, alternatively, at least as an aid in indicating time. In such use the oscillating pendulum periodically swings across the face of the clock adjacent the position at which the correct time is shown to indicate where such correct time is to be found.

Figure 1:
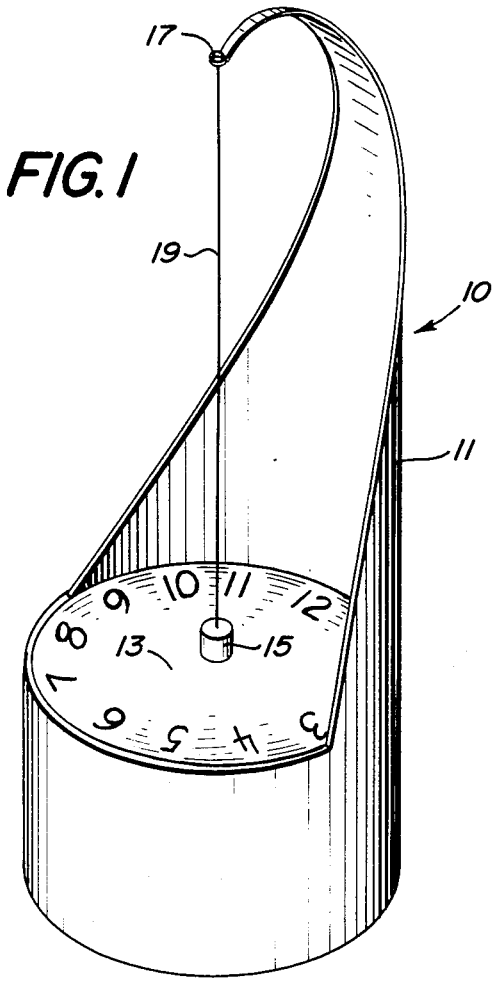
FIG. 1 is an isometric view of one embodiment of the horological device of the invention.
Figure 2:
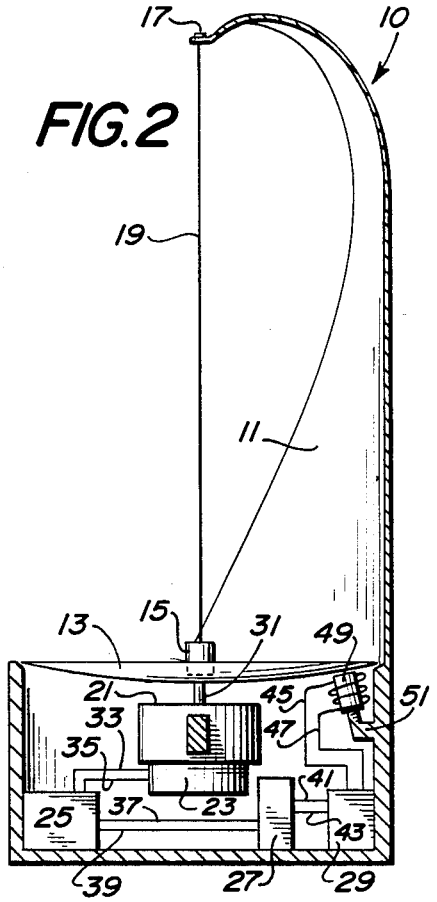
FIG. 2 is a sectional side view of the timekeeping device shown in FIG. 1.

Referring now to the drawings and particularly to FIGS. 1 and 2 for a detailed description of the invention, the timekeeping device 10 is seen to comprise generally a casing 11, a slightly concave clock face 13, a pendulum bob 15 and fixed point or suspension point 17 from which the pendulum bob 15 is suspended by a flexible but nonelastic cord or wire 19. By nonelastic is meant not significantly elongatable by the force of gravity as the bob 15 traverses the bottom portion of its oscillations. The flexible material could also be replaced by a rigid rod.

The clock casing 11 as shown in FIG. 2 houses a conventional electric clock mechanism 21, an electric motor 23, a power source 25 such as a battery or transformer connected to an outside power source, a timer 27 and a relay 29. The clock face 13, which may be formed from any rigid material such as ceramic, plastic or the like which will not interfere with a magnetic field, is positioned substantially horizontally within the clock casing 11 and supported on rotatable shaft 31 of clock or gearing mechanism 21 operated by the motor 23 which as described is an electric motor, but could be a mechanical type motor. A power source 25, which may be a battery or a transformer and rectifier connected to an alternating current source, is provided at one side of the base. The power source provides electrical energization via leads 33 and 35 to motor 23 and via leads 37 and 39 to timer 27 which in turn is connected via leads 41 and 43 to relay 29. Electrical leads 45 and 47 extend from relay 29 to an electromagnet 49 which is supported under one edge of the clock face 13 upon a bracket 51. The electromagnet is preferably slightly inclined so that the end is directed toward the pendulum at its closest point of approach.

When the relay 29 is activated by timer 27 direct current is sent via electrical leads 45 and 47 to electromagnet 49 and assuming the pendulum bob 15 has already been set oscillating the activation of the electromagnet 49 will, depending upon the timing supplied by the timer 27, add energy to the oscillation of the pendulum when said pendulum bob 15 swings toward the electromagnet under the influence of such electromagnet, either upon every oscillation of the pendulum or every other oscillation or some suitable regular energization schedule. It is not necessary for the electromagnet to be activated during every oscillation of the pendulum, but only sufficiently frequently to replace whatever energy the pendulum loses due to friction and other retarding influences so the pendulum will continue to oscillate regularly so long as the time indicating device is desired to operate. As indicated, it is not necessary for the electromagnet to add energy to the pendulum, i.e. draw it to its maximum height to supply whatever potential energy is necessary for continuous operation, upon every oscillation of the pendulum. It is likewise not necessary for the electromagnet to take complete control of the pendulum. In other words, the pendulum bob need not be in effect captured by the electromagnet so that the pendulum bob would be stopped and held by such electromagnet if the electromagnet was not timely deenergized, although momentary capture is not detrimental except as it may interrupt and lengthen the pendulum oscillation by whatever time the pendulum oscillation is halted or stopped. Such lengthening of the total oscillation period is, however, not serious unless extreme, since the track of the pendulum merely indicates the position beneath it at which the current time may be found. It is ordinarily sufficient, in most cases, however, if the electromagnet only add sufficient energy so that the pendulum bob is brought upon each activation of the electromagnet to some uniform elevation and is then allowed under the influence of gravity to continue its normal oscillation with the electromagnet deenergized.

As the pendulum oscillates in a straight line from one side of the clock face to the other, the clock face 13 rotates upon shaft 31 under the pendulum. The time in hours and minutes is marked on the clock face and its rotation is coordinated by the clockwork mechanism 21 so that the actual time of day is located preferably exactly at the position of the electromagnet to which the pendulum bob swings. As shown in FIG. 1, it is preferred for all the time indicia or numbers to face in the same direction, either in or out, with respect to the edge of the clock face so that as the face rotates the number which currently indicates the time of day is right side up with respect to the normal viewing position. As also shown, the electromagnet is positioned near the back of the clock since the clock face will normally be viewed from the front by the observer. The electromagnet could, however, be located almost anywhere in the clock and the pendulum bob made to swing to such point to indicate where the correct time of day is to be read. If the numbers face outward with respect to the edge of the clock face, for example, the pendulum could mark the time at the front edge of the face. If the clock face is translucent it may also be advantageous to cause a light to shine when the electromagnet is activated to further aid in indicating the correct time. As will be recognized, the pendulum clock arrangement as shown has considerable attractiveness as a novelty timepiece in which a continuously moving pendulum has not only a decorative function, but also serves to indicate the correct time.

It will readily be recognized that the clock face used with the embodiment of the invention shown in FIGS. 1 and 2 may be varied and may be a 12 hour face, a 24 hour face or any desired arrangement. The face may provide additional information besides time. The face need not be concave as shown, but the concavity allows the pendulum to swing close to the face. Otherwise the pendulum bob would tend to rise above the face at the sides making it difficult to determine the exact time and also requiring a more powerful electromagnet to exert the same force upon the pendulum. It may be advantageous in some instances if the periodicity of the pendulum is made to conform to a definite time period such as a certain number of seconds and this can be readily accomplished by adjusting the length of the pendulum in accordance with the relationship set forth in the equation for pendulum motion cited earlier. Since the pendulum bob should oscillate close to the surface of the base if the electromagnets are contained in the base, adjustment of the length of the pendulum may also require adjustment of the height of the pendulum support. Another variation which may often be desirable is to place the electromagnet to the side of the swing of the pendulum rather than underneath the pendulum as shown. For example, the electromagnet may be positioned in the side casing of the clock if such casing was made of sufficient thickness.

Figure 4:
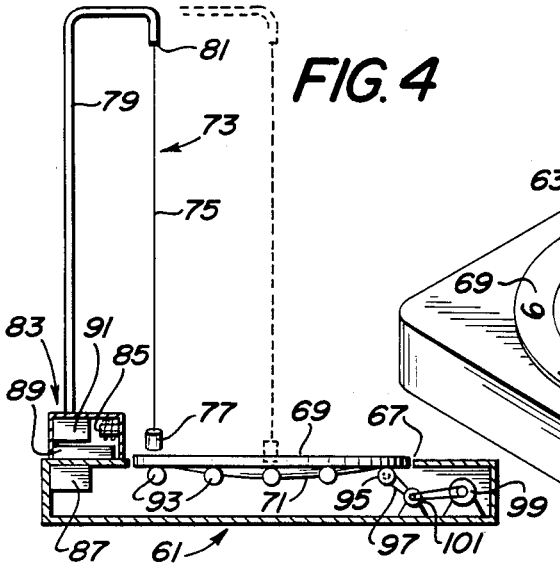
FIG. 4 is a sectional side view of the embodiment of the invention shown in FIG. 3.
Figure 3:
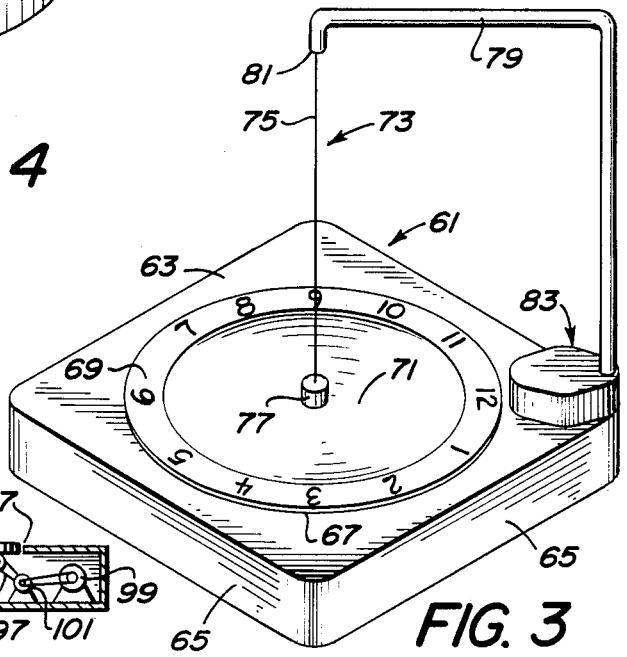
FIG. 3 is an isometric view of a further embodiment of the device of the invention.

FIGS. 3 and 4 depict a somewhat different embodiment of the invention in which the rotating clock face shown in FIGS. 1 and 2 is replaced by a rotating ring on which the normal time sequence is recorded. The pendulum swings back and forth across one segment of the ring in order to indicate the exact time as the ring rotates below it.

In FIG. 3 there is depicted a relatively low flat case 61 having a top 63 and sides 65. A circular opening 67 in the top of the case 61 receives a flat movable ring 69 which on the top is marked with clock time designations, in this case with hour designations from one to twelve with intermediate fractional designations representing minutes. The numbers will again either be faced out or in as shown in FIG. 3. The ring 69 may be referred to as the time sequence ring or time ring. If the pendulum 73 is suspended directly over the center portion 71 of the casing, such center portion is preferably at least somewhat concave, as shown by shading in FIG. 3, to accommodate the swing of a pendulum 73. The pendulum includes a suspension 75, a pendulum bob 77 and a support 79. The pendulum 73 is suspended from the support 79 at a fixed suspension point 81 essentially directly over the center portion 71 as shown in FIG. 3 and partially in phantom in FIG. 4 or may be suspended over one portion of the ring 69 as shown in full in FIG. 4. The support 79 extends from the top portion of an upper casing 83 positioned to one side of the top 63 of the casing 61. If the pendulum 73 is suspended over the ring as in FIG. 4, it is not necessary for the center portion 71 of the casing to be concave. It will be understood, however, that the portion of the casing over the suspension point could, if desired, be depressed and the time ring 69 slanted at an angle with the depressed side positioned under the suspension point to allow the pendulum to oscillate closer to the surface.

As shown in broken away form in FIG. 4 the upper casing 83 contains an electromagnet 85 positioned to the side of the oscillation path of the pendulum bob 77 so that activation of the electromagnet will draw the pendulum toward the electromagnet increasing the potential energy of the pendulum bob to replenish whatever energy the pendulum loses with time. Also contained within the upper casing 83 are a timer 89 and a relay 91. A power source 87 is positioned in case 61 under the upper casing 83. The power source 87, timer 89 and relay 91 are all similar to the same elements used in the embodiment of the invention shown in FIGS. 1 and 2 and it will be understood that the wiring, not shown, connecting the various elements will also be the same.

The time ring 69 is, as illustrated in FIG. 4, movably supported upon a series of roller bearings 93 journaled in the flat lower casing 61. A drive roll 95 is also journaled under the time ring 69 and is connected via a belt drive 97 to a drive motor 99 through an intermediate gear reducer 101. The drive 95 functions to slowly rotate the time ring 69 on the roller bearings 93 at a rate which will maintain the current time of day directly under the oscillations of the pendulum. An observer, therefore, can monitor or determine the time by referring to the time indicated on the upper surface of the time ring, the relevant time being found directly under the oscillating pendulum. As with the clock face shown in FIGS. 1 and 2, the clock or time ring shown in FIGS. 3 and 4 may be either a 12 or 24 hour clock or ring.

Figure 5:
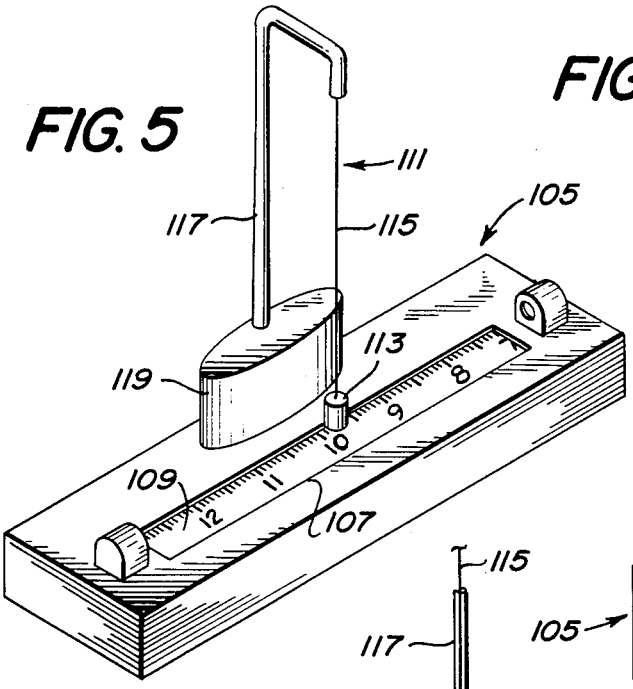
FIG. 5 is an isometric view of another embodiment of the invention.
Figure 7:
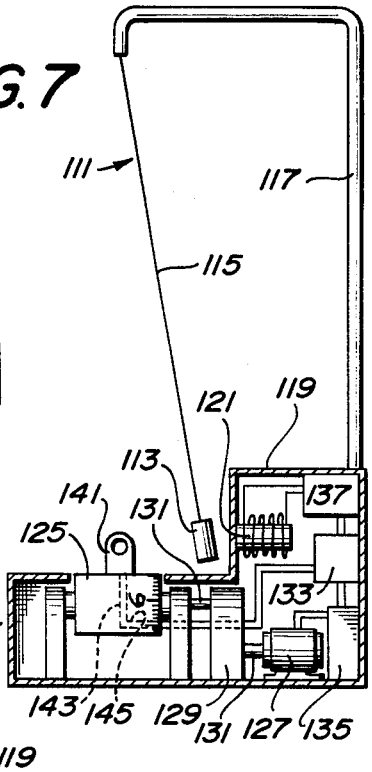
FIG. 7 is a cut away elevation of the embodiment of the invention shown in FIGS. 5 and 6.
Figure 6:
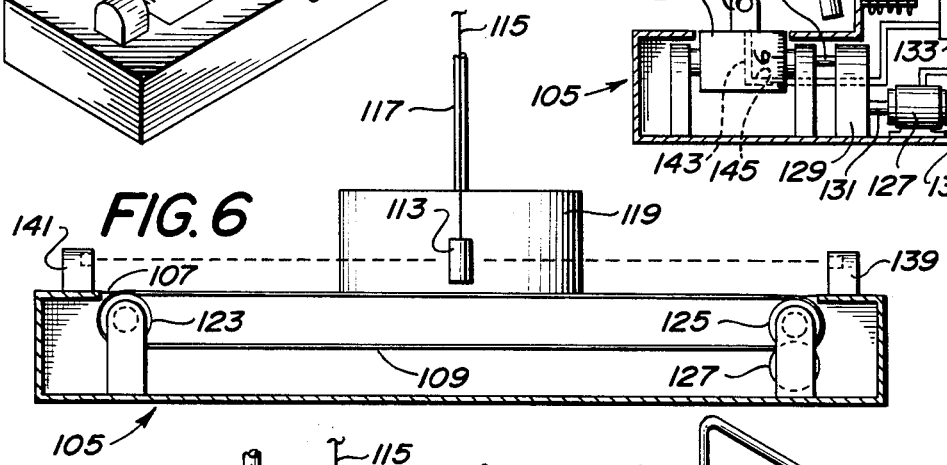
FIG. 6 is a cut away front elevation of the embodiment of the invention shown in FIG. 5.

FIGS. 5, 6 and 7 show a further embodiment of the invention involving the use of an endless tape or belt upon which time designations are marked. A pendulum is arranged to oscillate across the endless tape or belt at a predetermined position along the tape and the tape is coordinated to provide the correct indication of the time of day directly under the oscillating pendulum. FIG. 5 is an isometric view of a flat base 105 having a rectangular opening 107 in the top in which is positioned an endless belt 109 having designations of the daily time in hours and minutes on the surface. A pendulum 111 is suspended over the endless belt 109. The pendulum comprises a pendulum bob 113 with a suspension 115 attached to a support 117 mounted upon the upper surface of an upper casing 119 in which is positioned an electromagnet 121 as more particularly seen in the cut away elevation view shown in FIG. 7. As shown in FIG. 6 the endless belt 109 is rotatably mounted on a guide roll 123 and a drive roll 125 which is driven by an electric motor 127 through a reduction gear 129 and suitable coupling shafts 131. A timer or controller 133 is provided in the upper casing 119 along with a relay 137 which operates the electromagnet 121. The relay 137 is directly connected to the timer or controller 133 which is in turn connected to a power source 135 located in the base 105. There is also provided a photoelectric cell type detector 139 and light source 141 which are connected by leads 143 and 145 with the controller 133 to provide a signal every time the pendulum bob 113 swings through a light beam passing from the light source 141 to the photoelectric cell type detector 139. The light interrupt signal is sent to the controller 133 and on every alternate signal the electromagnet 121 is activated by the controller 133 as the pendulum swings toward the electromagnet 121. Other signal sequences could, of course, be used depending upon the frequency of magnetic activation desired.

While the embodiment shown in FIGS. 5, 6 and 7 involves the use of an endless roll or belt upon which time designations are indicated, which belt passes below an oscillating pendulum which serves to indicate the exact time as it passes below the pendulum, it will be understood that instead of passing the belt by the pendulum to indicate the time, the pendulum might be carried past a strip upon which are recorded the hours and minutes of the day. For example, the upper casing 119 in FIGS. 5, 6 and 7 could be mounted for roller movement along the surface of the lower casing 105 carrying the oscillating pendulum with it. Meanwhile an entire 12 hour period would be recorded on a stationary strip laid out upon or secured to the top of the lower casing 105. While possible, such an arrangement would require a longer base to accommodate the hour designations, would be more complicated because of the necessity to return the pendulum carriage to the beginning of the time sequence strip at the end of one 12 hour traverse and might also unless very smooth operating tend to cause deviation of the pendulum path as the result of vibration or other movement of the pendulum support. The arrangement shown in FIGS. 5, 6 and 7 is, therefore, in general more convenient and practical.

It would also be possible in an arrangement such as shown in FIGS. 3 and 4 to rotate the pendulum support 79 around the time ring together with the pendulum rather than rotating the time ring 69 past the oscillating pendulum. This, however, would have the disadvantage of subjecting the pendulum to increased vibration, possibly deviating the oscillations of the pendulum and also, since an oscillating pendulum tends to have some of the characteristics of a gyroscope, the oscillations of the pendulum would tend to become disturbed. While it might be supposed that the electromagnet would tend to keep the pendulum bob always oscillating toward and away from said magnet, in fact as the electromagnet moved with the moving carriage it would tend to draw the pendulum bob to one side at one end of its swing resulting in an unpredictable elliptical oscillation path which is not satisfactory for accurate indications of time. In addition such elliptical oscillations may also in time bring the pendulum beyond the effective influence of the electromagnet so the constant potential energy loss in the pendulum due to friction and the like is not replaced by the electromagnet. An improved arrangement which avoids such difficulties is disclosed and claimed in the concurrently filed application entitled Pendulum Indicator Horological Device referred to under Cross References to Related Applications above.

Figure 8:
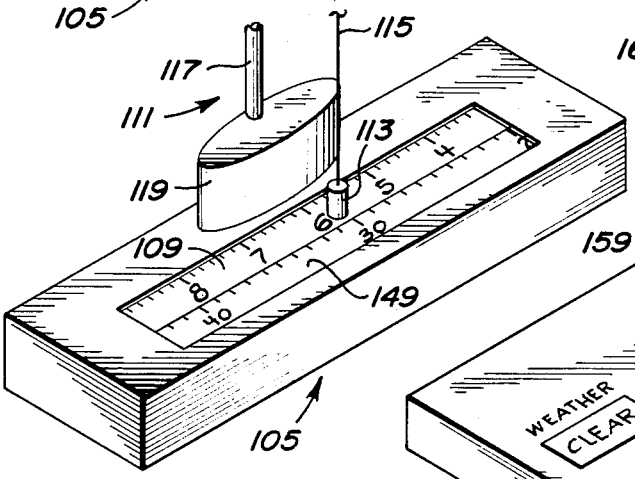
FIG. 8 is an isometric view of a modification or improvement of the invention shown in FIGS. 5, 6 and 7 incorporating a separate minute indicator.

FIG. 8 shows in an isometric view a variation of the embodiment of the invention shown in FIG. 5 incorporating two side by side time indicating belts. Belt 109 carries an indication of the hours and minutes as in FIG. 6, while belt 149 carries an indication of elapsed seconds. The other elements shown in FIG. 8 are the same as shown in FIG. 5 and are designated by the same reference numerals. The pendulum 111 indicates both the hours and minutes and the elapsed seconds since the beginning of the current minute. In order to accomplish this the second belt 149 must run at a greater speed than the hour and minute belt and if in fact both are the same length as shown in FIG. 8 the second belt 149 must operate at a speed seven hundred and twenty times the speed of the first belt 109. This can be arranged for by providing two motors, not shown, or by differential gearing from one motor, also not shown. It will be recognized that a similar arrangement for indicating elapsed time could be provided for providing elapsed second information in the embodiment of FIG. 3. In such case an additional or second ring could be added to the outside of the time ring 69 as shown. Again the second time indicator would have to run faster. It will be understood that a third ring could be added in FIG. 3 or a third belt in FIG. 8 to allow for precise indication of the minutes also. Such a ring or belt would operate at an intermediate speed between the hour and the second indicating means.

Figure 9:
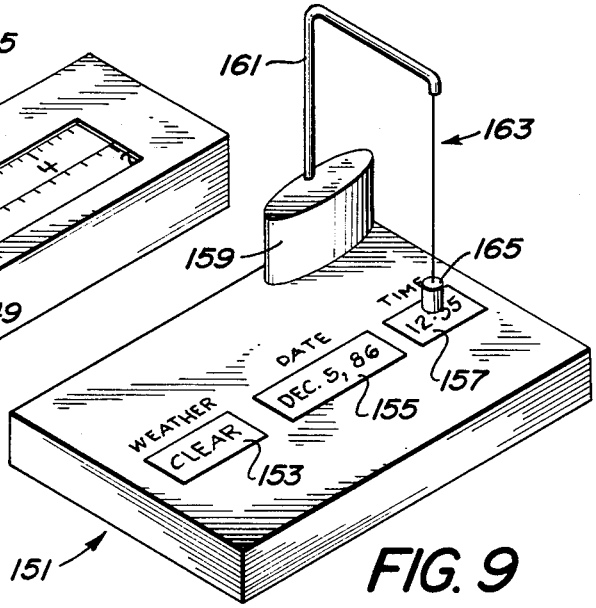
FIG. 9 is an isometric view of a further embodiment of the invention.

FIG. 9 is an isometric view of a still further embodiment of the invention where the time representation is in digital form. In FIG. 9 there is shown in isometric representation an information base 151 having several electronic digital displays on the surface, including a weather display 153 which may receive information from externally or from an internal hygrometer, not shown, a date display 155, and a time display 157. The time display is positioned adjacent to an upper casing 159 on the upper surface of which is mounted a pendulum support 161 from which is suspended a pendulum 163. It will be understood that an electromagnet, not shown, is mounted in the housing or casing 159 and that upon activation of the electromagnet, as in the previous embodiments, the pendulum bob 165 is attracted to the electromagnet, passing over or above the digital display of time and in so doing drawing attention to such display. When the electromagnet is deenergized as described in the previous embodiments by a suitable timer or the like the pendulum swings away from the vicinity of the electromagnet in the usual pendular type oscillation, again swinging over the digital time display and calling attention to it and thus broadly indicating the time. It may in some instances be desirable to coordinate the swinging of the pendulum to indicate actual second time intervals or it may be desirable to provide a blinking light or the like to so indicate with every oscillation of the pendulum.

Various modifications of the invention may be made. One very practical modification which can be made to the embodiments shown in FIGS. 1 to 4, for example, is the provision of a transparent glass or plastic dome over substantially the entire base. The dome is provided with a suspension point in the upper portion, usually the center, from which the pendulum may be suspended. If desired the transparent dome can be arranged to rotate and time indicia can be placed on the lower side portions to indicate the time either in place of or in conjunction with a rotating time indica in the base.

The relationship of the electromagnet or electromagnets and the swing of the pendulum bob can also be varied. For example, the pendulum bob may at the end of its swing be positioned near the electromagnet or housing for the electromagnet or an intermediate housing or a stop, in which case the electromagnet itself or the intermediate casing structure or stop will define the extreme end of the swing of the pendulum. The pendulum bob and the electromagnet or intermediate casing, stop, or other fixed means may also be designed to make an audible click or the like as they contact each other at the end of the pendulum swing, which click may also be used as a measure of time. The embodiments shown in FIGS. 3 through 9 may be arranged and constructed to operate in the manner described.

It will also be evident that while the invention has been shown and described in the form of a base from which a pendulum support extends and in which the electromagnets are housed, various other arrangements could be used, including a separate pendulum support, suspension of the pendulum from an existing overhead structure such as the ceiling, housing of the electromagnets and time indicia in existing structures and the like. In such arrangements the pendulum support and the nominal base may be considered to be associated rather than directly connected together.

In each of the embodiments shown in the accompanying Figures and described above it is necessary at some point to initiate the motion of the pendulum. This is in most cases easily done since the power need only be turned on by operation of an appropriate switch, which it has not been thought necssary in most cases to illustrate, by plugging in the power source or the like. The appropriate timing means will then begin energizing the electromagnets as programmed. At this point the pendulum may be manually biased to the side toward one or the other of the electromagnets sufficiently such that the effective magnetic field of the magnet when activated in turn will be sufficient to take control of the pendulum bob. The apparatus will thereafter continue to operate in its predetermined sequence. The pendulum bob can be biased toward the electromagnet by physically grasping the pendulum and thrusting it toward the magnet or by tilting the casing or housing of the apparatus so that the effects of gravity draw the pendulum bob toward an appropriate electromagnet. Of course, a mechanical biasing means or device of suitable design could also be incorporated into the apparatus to aid in initial deviation of the pendulum. Once operation is initiated the device of the invention will continue to cycle through its prdetermined program as long as sufficient power is supplied.

While it will be understood that the invention has been described in considerable detail and specificity in connection with the above drawings and explanation of the various embodiments illustrated, the invention is not to be limited to the particulars of any such embodiments, but is meant to be construed broadly with reference to the language of the appended claims so as to provide the broadest possible interpretation of such claims in view of the prior art and thereby to effectively encompass the intended scope of the invention.

I claim:

1. A time keeping device comprising:

(a) an at least partially upwardly facing surface structure, (b) time indicia means associated with said partially upwardly facing surface, (c) pendulum means arranged for oscillation over the portion of the time indicia means indicating actual time during such oscillation, (d) electromagnetic means positioned adjacent to said time indicia in position to maintain oscillation of said pendulum across the time indicia means, (e) intermittent energization means for energizing the electromagnetic means, (f) timing means for controlling the intermittent energization of said intermittent energization means to the portion of the oscillation of the pendulum approaching the electromagnetic means.

2. A time keeping device in accordance with claim 1 wherein the time indicia means is linearly extended and the oscillation path of said pendulum is substantially transverse of the linear extent of said time indicia.

3. A time keeping device in accordance with claim 1 wherein the time indicia means is curvilinearly extended and the oscillation path of said pendulum is substantially transverse of the curvilinear extent of said time india.

4. A time keping device in accordance with claim 2 wherein the time idicia is moved past the oscillating pendulum to indicate current time.

5. A time keeping device in accordance with claim 3 wherein the time indicia is rotated past the oscillating pendulum to indicate current time.

6. A time keeping device in accordance with claim 4 wherein the time indicia is in the form of an endless belt.

7. A time keeping device in accordance with claim 5 wherein the time indicia is in the form of a rotating clock face adjacent the periphery of which individual time indicia are marked.

8. A time keeping device in accordance with claim 5 wherein the time indicia takes the form of a rotating ring upon the upper surface of which individual time indicia are marked.

9. A time keeping device in accordance with claim 1 wherein the time indicia comprises a variable indicator in a constant position and the pendulum means oscillates across said constant position to indicate and draw the attention of an observer to the variable time indication indicated by said variable indicator.

10. A time keeping device in accordance with claim 1 wherein the time indicia are provided on a structure closely related to the surface structure.

11. A time keeping device comprising:

(a) time indicia means, (b) pendulum means arranged for oscillation toward and away from said time indicia, (c) electromagnetic means positioned adjacent said time indicia, (d) intermittent energization means for energizing the electromagnetic means, (e) timing means for controlling the intermittent energization of said energization means to the portion of the oscillation of the pendulum approaching the electromagnetic means.

12. A time keeping device according to claim 11 wherein the time indicia means is comprised of a plurality of indicia extended linearly and the pendulum means is arranged for oscillation transversely of the average linear extent of said time extended time indicia.

13. A time keeping device according to claim 12 wherein the time indicia is extended in substantially a straight linear pattern.

14. A time keeping device according to claim 12 wherein the time indicia is extended in a curvilinear pattern.

15. A time keeping device in accordance with claim 13 wherein the time indicia is arranged for passage past the transversely oscillating pendulum.

16. A time keeping device in accordance with claim 14 wherein the time indicia is arranged for passage past the transversely oscillating pendulum.

17. A time keeping device in accordance with claim 12 wherein the pendulum means is arranged to contact a fixed means at the end of a pendulum oscillation.

18. A time keeping device in accordance with claim 17 wherein the pendulum and fixed means are arranged and constructed to emit an audible sound as they contact.

* * * * *